US008168008B2

(12) United States Patent
Miyata et al.

(10) Patent No.: US 8,168,008 B2
(45) Date of Patent: May 1, 2012

(54) MARTENSITIC STAINLESS STEEL PIPE

(75) Inventors: Yukio Miyata, Tokyo (JP); Mitsuo Kimura, Tokyo (JP); Noritsugu Itakura, Tokyo (JP); Katsumi Masamura, Tokyo (JP)

(73) Assignee: JFE Steel Corporation (JP)

( * ) Notice: Subject to any disclaimer, the term of this patent is extended or adjusted under 35 U.S.C. 154(b) by 477 days.

(21) Appl. No.: 10/587,807

(22) PCT Filed: Dec. 1, 2004

(86) PCT No.: PCT/JP2004/018233

§ 371 (c)(1),
(2), (4) Date: Jul. 28, 2006

(87) PCT Pub. No.: WO2005/073419

PCT Pub. Date: Aug. 11, 2005

(65) Prior Publication Data

US 2009/0017238 A1 Jan. 15, 2009

(30) Foreign Application Priority Data

Jan. 30, 2004 (JP) ..... 2004-024687
Apr. 30, 2004 (JP) ..... 2004-135975
Nov. 12, 2004 (JP) ..... 2004-329060

(51) Int. Cl.
*C22C 38/40* (2006.01)

(52) U.S. Cl. ..... 148/325; 420/70

(58) Field of Classification Search ..... 148/325, 148/326; 420/34, 37, 38, 39, 40, 41, 56, 420/57, 58, 60, 61, 64, 66, 67, 68, 69, 70; 75/325, 326

See application file for complete search history.

(56) References Cited

U.S. PATENT DOCUMENTS 5,820,703 A * 10/1998 Suzuki et al. ..... 148/593
5,985,209 A * 11/1999 Kimura et al. ..... 420/61
6,464,802 B1 * 10/2002 Miyata et al. ..... 148/325
7,842,141 B2 * 11/2010 Kimura et al. ..... 148/325

FOREIGN PATENT DOCUMENTS

EP 1026273 * 8/2000
JP 8-41599 2/1996
JP 2001-279392 A 10/2001
JP 2002-105604 * 4/2002

OTHER PUBLICATIONS

English translation of JP 2002-105604, Mitsuo Kimura, published Apr. 10, 2002, 26 pages total.*

* cited by examiner

*Primary Examiner* — George Wyszomierski
*Assistant Examiner* — Mark L Shevin
(74) *Attorney, Agent, or Firm* — DLA Piper LLP (US)

(57) ABSTRACT

A martensitic stainless steel pipe having a heat-affected zone with high resistance to intergranular stress corrosion cracking is provided. In particular, the martensitic stainless steel pipe contains less than 0.0100% of C; less than 0.0100% of N; 10% to 14% of Cr; and 3% to 8% of Ni on a mass basis. Alternatively, the martensitic stainless steel pipe may further contain Si, Mn, P, S, and Al within an appropriate content range. The martensitic stainless steel pipe may further contain one or more selected from the group consisting of 4% or less of Cu, 4% or less of Co, 4% or less of Mo, and 4% or less of W and one or more selected from the group consisting of 0.15% or less of Ti, 0.10% or less of Nb, 0.10% or less of V, 0.10% or less of Zr, 0.20% or less of Hf, and 0.20% or less of Ta on a mass basis. The content $C_{sol}$ defined by the following equation is equal to less than 0.0050%: $C_{sol}=C-\frac{1}{3}\times C_{pre}$, wherein $C_{pre}=12.0\ \{Ti/47.9+\frac{1}{2}(Nb/92.9+Zr/91.2)+\frac{1}{3}(V/50.9+Hf/178.5+Ta/180.9)-N/14.0\}$ or $C_{pre}=0$ when $C_{pre}<0$.

16 Claims, 1 Drawing Sheet

MARTENSITIC STAINLESS STEEL PIPE

TECHNICAL FIELD

This disclosure relates to a martensitic stainless steel pipe suitable for pipelines for natural gas and oil and particularly relates to an improvement in resistance to intergranular stress corrosion cracking occurring in heat-affected zones.

BACKGROUND

In recent years, in order to cope with a high increase in the price of crude oil and in order to guard against the depletion of oil resources that may occur in near future, the following wells have been extensively developed worldwide: deep oil wells that have not attracted much attention and sour gas wells which are highly corrosive and of which the development has therefore been abandoned once. Steel pipes used for such oil wells and gas wells must have high corrosion resistance.

In environments containing a large amount of, for example, carbon dioxide, inhibitors have been used to prevent corrosion. However, the use of such inhibitors causes an increase in cost and the inhibitors cannot provide sufficient advantages under high temperature conditions in some cases. Therefore, steel pipes with high corrosion resistance have been recently used without using the inhibitors.

The API standards specify that 12%-Cr martensitic stainless steel with a reduced C content be suitable for line pipes. In recent years, martensitic stainless steel pipes have been used for pipelines for natural gas containing $CO_2$. There is a problem in that such martensitic stainless steel pipes must be preheated or subjected to post-welding heat treatment when they are girth-welded. Furthermore, there is a problem in that welded portions thereof are inferior in toughness.

In order to cope with such problems, for example, Japanese Unexamined Patent Application Publication No. 9-316611 discloses martensitic stainless steel having a C content of 0.02% or less, an N content of 0.07% or less, an appropriate Cr content, an appropriate Ni content, and an appropriate Mo content. The Cr content, the Ni content, and the Mo content are adjusted in relation to the C content or the C content and the N content and the Ni content and the Mo content are adjusted in relation to the C content and the N content. A martensitic stainless steel pipe manufactured using the steel disclosed in this document is superior in $CO_2$ corrosion resistance, resistance to stress corrosion cracking, weldability, and high-temperature strength and the toughness of a welded section of the pipe is high.

SUMMARY

The following new problem has recently arisen: a problem in that cracking occurs in heat-affected zones (hereinafter referred to as HAZs) of martensitic stainless steel pipes which is subject to girth-welding in environments containing $CO_2$.

Examples of corrosion occurring in environments containing $CO_2$ include $CO_2$ corrosion and stress corrosion cracking that cause a reduction in the thickness of base metal materials. Cracking which is the recent problem occurs only in HAZs of girth-welded pipes. Furthermore, this type of cracking is characteristic in that it occurs in mild corrosion environments in which $CO_2$ corrosion never occurs. Since this type of cracking occurs along grain boundaries, it is presumed to be intergranular stress corrosion cracking (hereinafter referred to as IGSCC).

It is known that short-time post-welding heat treatment in which HAZs of girth-welded pipes are maintained at 600° C. to 650° C. for three to five minutes is effective in preventing IGSCC from occurring in the HAZs. However, the use of the post-welding heat treatment causes the following problems although it takes a short time for the treatment: an increase in the number of process steps of constructing a pipeline, an increase in construction time, and an increase in construction cost. Therefore, the following pipe has been demanded: a martensitic stainless steel pipe of which a HAZ hardly suffers from IGSCC in an environment containing $CO_2$ and the HAZ needs not post-welding heat treatment.

We therefore provide a martensitic stainless steel pipe of which a heat-affected zone has high resistance to intergranular stress corrosion cracking.

We have intensively investigated the cause of IGSCC occurring in HAZs of girth-welded martensitic stainless steel pipes. As a result, we found that carbides dispersed in a matrix are dissolved into matrix during a welding thermal cycle and Cr carbide precipitates at prior-austenite grain boundaries during following welding thermal cycles to cause the formation of Cr depleted zones around the prior-austenite grain boundaries; hence, IGSCC occurs.

It is known that stress corrosion cracking caused by such a mechanism occurs in austenitic stainless steel, but it is not presumed that the cracking occurs in martensitic stainless steel. The Cr depleted zones were considered not to be formed in the martensitic stainless steel since the diffusion rate of Cr in a martensitic microstructure is extremely greater than that in an austenitic microstructure and Cr is therefore constantly supplemented even if Cr carbide is formed. However, we found that the Cr depleted zones are formed even in the martensitic stainless steel under specific welding conditions and IGSCC occurs in a mild corrosion environment.

We further found that it is critical to prevent Cr carbide from being formed at prior-austenite grain boundaries to prevent IGSCC and the effective content $C_{sol}$ of dissolved carbon that affects the formation of Cr carbide must therefore be reduced to less than about 0.0050% by mass in such a manner that the C content is extremely reduced or the content of a carbide-forming element, such as Ti, Nb, V, or Zr, having higher ability to precipitate carbides than that of Cr is increased.

Thus, selected aspects include:

(1) A martensitic stainless steel pipe having a heat-affected zone with high resistance to intergranular stress corrosion cracking and contains less than about 0.0100% of C; less than about 0.0100% of N; about 10% to about 14% of Cr; and about 3% to about 8% of Ni on a mass basis, wherein the content $C_{sol}$ defined by the following equation (1) is equal to less than 0.0050%:

$$C_{sol}=C-\tfrac{1}{3}\times C_{pre} \quad (1)$$

where $C_{pre}=12.0\{Ti/47.9+\tfrac{1}{2}(Nb/92.9+Zr/91.2)+\tfrac{1}{3}(V/50.9+Hf/178.5+Ta/180.9)-N/14.0\}$ or $C_{pre}=0$ when $C_{pre}<0$, where C represents the carbon content, the definition of $C_{pre}$ appears later in equation (2), Ti represents the titanium content, Nb represents the niobium content, Zr represents the zirconium content, V represents the vanadium content, Hf represents the hafnium content, Ta represents the tantalum content, and N represents the nitrogen content on a mass basis.

(2) The martensitic stainless steel pipe specified in Item (1) further contains less than about 0.0100% of C; less than about 0.0100% of N; about 10% to about 14% of Cr; about 3% to about 8% of Ni; about 0.05% to about 1.0% of Si; about 0.1% to about 2.0% of Mn; about 0.3% or less of P; about 0.010% or less of S; about 0.001% to about 0.10% of Al; one or more selected from the group consisting of about 4% or less of Cu, about 4% or less of Co, about 4% or less of Mo, and about 4% or less of W; and one or more selected from the group consisting of about 0.15% or less of Ti, about 0.10% or less of Nb, about 0.10% or less of V, about 0.10% or less of Zr, about 0.20% or less of Hf, and about 0.20% or less of Ta on a mass basis, the remainder being Fe and unavoidable impurities, wherein the content $C_{sol}$ defined by equation (1) is equal to less than 0.0050%.

(3) The martensitic stainless steel pipe specified in Item (2) further contains one or more selected from the group consisting of about 0.010% or less of Ca, about 0.010% or less of Mg, about 0.010% or less of REM, and about 0.010% or less of B on a mass basis.

(4) The martensitic stainless steel pipe specified in Item (1) further contains less than about 0.0100% of C; less than about 0.0100% of N; about 10% to about 14% of Cr; about 3% to about 8% of Ni; about 0.05% to about 1.0% of Si; about 0.1% to about 2.0% of Mn; about 0.03% or less of P; about 0.010% or less of S; about 0.001% to about 0.10% of Al; about 0.02% to about 0.10% of V; about 0.0005% to about 0.010% of Ca; and one or more selected from the group consisting of about 4% or less of Cu, about 4% or less of Co, about 4% or less of Mo, and about 4% or less of W on a mass basis, the remainder being Fe and unavoidable impurities, wherein the content $C_{sol}$ defined by equation (1) is equal to less than 0.0050%.

(5) The martensitic stainless steel pipe specified in Item (4) further contains one or more selected from the group consisting of about 0.15% or less of Ti, about 0.10% or less of Nb, about 0.10% or less of Zr, about 0.20% or less of Hf, and about 0.20% or less of Ta on a mass basis.

(6) The martensitic stainless steel pipe specified in any one of Items (1) to (5) is suitable for line pipe uses.

(7) A welded structure comprising the martensitic stainless steel pipe specified in any one of Items (1) to (6), the pipe being welded to a member.

DETAILED DESCRIPTION

Figure 1:
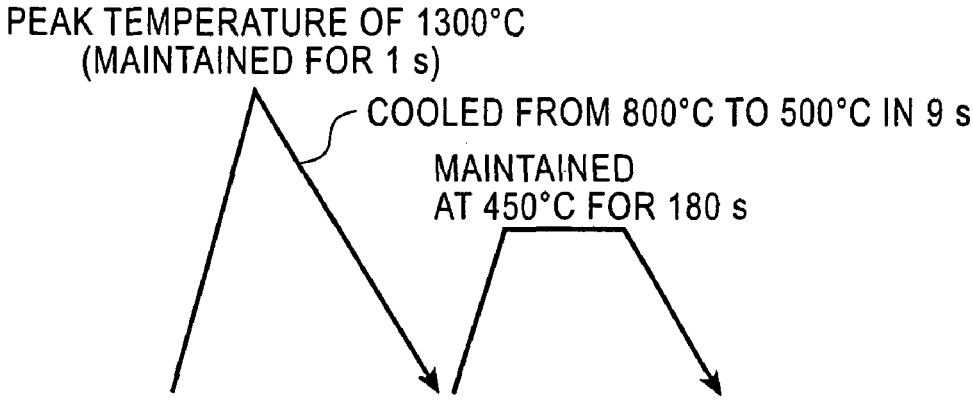
FIG. 1 is an illustration schematically showing a simulated welding thermal cycle used in an example of our steel.

The composition of steel pipes will now be described. In the description below, the composition is simply expressed in % instead of % by mass.

Less than 0.0100% C

Although C is an element that forms a solution in steel and enhances the strength of the steel, a large increase in the C content causes an increase in the hardness of HAZs, an occurrence of welding cracks, and/or a deterioration in the toughness of such HAZs. Therefore, the C content is preferably low. To prevent IGSCC from occurring in the HAZs, the C content is limited to less than 0.0100% because C forms Cr carbide, which precipitates to create Cr depleted zones. When the C content is 0.0100% or more, IGSCC can hardly be prevented from occurring in the HAZs. The C content is preferably less than 0.0050%.

The C content is limited to the above range and the content of other elements are adjusted such that the effective content $C_{sol}$ of dissolved carbon is reduced to less than 0.0050%. This prevents the Cr depleted zones from being formed, whereby IGSCC can be substantially prevented from occurring in the HAZs. The term "IGSCC can be substantially prevented" means that IGSCC does not occur in welded joints placed in an ordinary environment (for example, an environment with a $CO_2$ partial pressure of 0.1 MPa, a liquid temperature of 100° C., and a 5% NaCl aqueous solution with a pH of 4.0) in which welded line pipes are usually used, the joints being welded under usual conditions (for example, TIG welding performed with a heat input of 10 kJ/cm).

The effective content of dissolved carbon $C_{sol}$ is represented by the following equation (1):

$$C_{sol}=C-\tfrac{1}{3}\times C_{pre} \quad (1)$$

The term "effective content of dissolved carbon $C_{sol}$" means the amount of C that forms Cr carbide that precipitates to create Cr depleted zones during welding. The $C_{sol}$ is determined by subtracting the content of C that bonds to a carbide-forming element such as Ti, Nb, Zr, V, Hf, or Ta from the total C content. That is, the effective content of dissolved carbon $C_{sol}$ is determined by subtracting the content of C that is not consumed in the formation of Cr carbide from the total C content. The content $C_{pre}$ is represented by the following equation (2):

$$C_{pre}=12.0\{Ti/47.9+\tfrac{1}{2}(Nb/92.9+Zr/91.2)+\tfrac{1}{3}(V/50.9+Hf/178.5+Ta/180.9)-N/14.0\} \quad (2)$$

wherein C represents the carbon content, Ti represents the titanium content, Nb represents the niobium content, Zr represents the zirconium content, V represents the vanadium content, Hf represents the hafnium content, Ta represents the tantalum content, and N represents the nitrogen content in percent by mass and $C_{pre}=0$ when $C_{pre}<0$. When the content $C_{pre}$ is calculated, the content of uncontained one among the elements used in equation (2) is zero. These elements have different abilities to form carbide and different abilities to dissolve carbide. Therefore, in the equation to determine the content $C_{pre}$ used herein, the abilities of Nb and Zr are estimated to be one half of the ability of Ti and the abilities of V, Hf, and Ta are estimated to be one third of the ability of Ti based on experiment results. Since the steel pipe contains N, the following elements primarily form nitrides: Ti, Nb, Zr, V, Hf, and Ta. Therefore, in the equation to determine the content $C_{pre}$ used herein, the content of N that forms nitrides together with Ti, Nb, Zr, V, Hf, and Ta is subtracted from the total N content. In consideration that the Cr depleted zones are formed in the HAZs, that is, the HAZs are in a nonequilibrium state, the content of C that forms carbides other than Cr carbide to prevent the formation of Cr carbide is estimated to be one third of the content $C_{pre}$.

When the steel pipe does not contain Ti, Nb, Zr, V, Hf, nor Ta, the content $C_{pre}$ has a negative value. The content $C_{pre}$ having a negative value is assumed to be zero and the effective content $C_{sol}$ of dissolved carbon is therefore equal to the C content, Hence, to satisfy the condition that the effective content of dissolved carbon is equal to less than 0.0050%, it is critical to adjust the C content to less than 0.0050%.

Less than 0.0100% N

N, as well as C, is an element that forms a solution in steel and enhances the steel strength. A large increase in the N content causes an increase in the hardness of the HAZs, an occurrence of welding cracks, and/or a deterioration in the toughness of the HAZs. Therefore, the content of N is preferably low. N bonds to Ti, Nb, Zr, V, Hf, and Ta to form nitrides. This leads to the reduction in the content of Ti, Nb, Zr, V, Hf, and Ta that can form carbides to prevent the formation of Cr carbide and also leads to the deterioration in ability to prevent IGSCC by preventing the formation of the Cr depleted zones. Therefore, the N content is preferably low.

Since the negative effects of N are negligible when the N content is less than 0.0100%, the N content is herein limited to less than 0.0100%. The N content is preferably 0.0070% or less.

10% to 14% Cr

Cr is a basic element for enhancing corrosion resistances such as $CO_2$ corrosion resistance, pitting resistance, and resistant to sulfide stress cracking. The Cr content must be 10% or more. However, when the Cr content is more than 14%, the ferrite phase is likely to be formed suppressing formation of martensitic microstructure. Therefore, in order to form a martensitic microstructure with high reproducibility, a large amount of an alloy element must be used. This causes an increase in material cost. Thus, the Cr content is limited to the range of 10% to 14%.

3% to 8% Ni

Ni is an element that enhances $CO_2$ corrosion resistance, toughness, and solid solution hardening. Furthermore, Ni is an element for forming austenite and is useful in forming a martensitic microstructure with high reproducibility when steel has low carbon content. In order to achieve such advantages, the Ni content must be 3% or more. However, when the Ni content is more than 8%, it takes a long time for tempering to obtain desired characteristics because the transformation temperature becomes too low. This causes an increase in material cost. Thus, the Ni content is limited to the range of 3% to 8%. The Ni content is preferably 4% to 7%.

In addition to the above basic elements, the elements below may be contained.

0.05% to 1.0% Si

Si is an element that functions as a deoxidizing agent and enhance solid solution hardening. The Si content may be 0.05% or more. However, when the Si content is more than 1.0%, the toughness of a base metal material and the toughness of the HAZs are low because Si is an element for forming ferrite. Therefore, the Si content is preferably limited to the range of 0.05% to 1.0%. The Si content is more preferably 0.1% to 0.5%.

0.1% to 2.0% Mn

Mn is an element that increases solid solution hardening, forms austenite, and prevents the formation of ferrite to enhance the toughness of the base metal material and that of the HAZs. In order to achieve such advantages, the Mn content is preferably 0.1% or more. However, when the Mn content is more than 2.0%, the effect thereof is saturated. Therefore, the Mn content is limited to the range of 0.1% to 2.0%. The Mn content is more preferably 0.2% to 1.2%.

0.03% or Less P

P is an element that segregates at grain boundaries to reduce the strength of the grain boundaries and has a reverse effect on resistance to stress corrosion cracking. The P content is preferably low. The allowance of the P content is 0.03% or less. Therefore, the P content is preferably limited to 0.03% or less. In view of hot workability, the P content is preferably 0.02% or less. Since an excessive decrease in the P content causes a large increase in refining cost and a decrease in productivity, the P content is preferably 0.010% or more.

0.010% or Less S

S is an element that forms a sulfide such as MnS to cause a deterioration in machinability. The S content is preferably low. The allowance of the S content is 0.010% or less. Therefore, the S content is preferably limited to 0.010% or less. Since an excessive decrease in the S content causes a large increase in refining cost and a decrease in productivity, the S content is preferably 0.0005% or more.

0.001% to 0.10% Al

Al functions as a deoxidizing agent and the content thereof is preferably 0.001% or more. When the Al content is more than 0.10%, the toughness is low. Therefore, the Al content is preferably limited to the range of 0.001% to 0.10%. The Al content is more preferably 0.01% to 0.04%.

One or More Selected from the Group Consisting of 4% or Less Cu, 4% or Less Co, 4% or Less Mo, and 4% or Less W Cu, Co, Mo, and W are elements for enhancing $CO_2$ corrosion resistance that is one of properties necessary for steel pipes for pipelines for transporting natural gas containing $CO_2$. The steel pipe contains one or more selected from those components in addition to Cr and Ni.

4% or less Cu

Cu is an element that enhances $CO_2$ corrosion resistance, forms austenite, and is useful in forming a martensitic microstructure with high reproducibility when steel has low carbon content. In order to achieve such advantages, the Cu content is preferably 1% or more. However, when the Cu content is more than 4%, the effect thereof is saturated and cost efficiency is low because advantages appropriate to the content cannot be obtained. Therefore, the Cu content is preferably limited to 4% or less. The Cu content is more preferably 1.5% to 2.5%.

4% or less Co

Co, as well as Cu, is an element that enhances $CO_2$ corrosion resistance, forms austenite, and is useful in forming a martensitic microstructure with high reproducibility when steel has low carbon content. In order to achieve such advantages, the Co content is preferably 1% or more. However, when the Co content is more than 4%, the effect thereof is saturated and cost efficiency is low because advantages appropriate to the content cannot be obtained. Therefore, the Co content is preferably limited to 4% or less. The Co content is more preferably 1.5% to 2.5%.

4% or Less Mo

Mo is an element for enhancing resistance to stress corrosion cracking, resistant to sulfide stress cracking, and pitting resistance. In order to achieve such advantages, the Mo content is preferably 0.3% or more. However, when the Mo content is more than 4%, ferrite is likely to be formed and the effect of enhancing the resistant to sulfide stress cracking is saturated, that is, any advantage appropriate to the content cannot be obtained; hence, cost efficiency is low. Therefore, the Mo content is preferably limited to 4% or less. The Mo content is more preferably 1.0% to 3.0%. The Mo content is further more preferably 1.5% to 3.0%.

4% or Less W

W, as well as Mo, is an element for enhancing resistance to stress corrosion cracking, resistant to sulfide stress cracking, and pitting resistance. In order to achieve such advantages, the W content is preferably 1% or more. However, when the W content is more than 4%, ferrite is formed and the effect of enhancing the resistant to sulfide stress cracking is saturated, that is, any advantage appropriate to the content cannot be obtained; hence, cost efficiency is low. Therefore, the W content is preferably limited to 4% or less. The W content is more preferably 1.5% to 3.0%.

One or More Selected from the Group Consisting of 0.15% or Less Ti, 0.10% or Less Nb, 0.10% or Less V, 0.10% or Less Zr, 0.20% or Less Hf, and 0.20% or Less Ta Ti, Nb, V, Zr, Hf, and Ta are elements for forming carbides. The steel pipe contains one or more selected from those elements. Ti, Nb, V, Zr, Hf, and Ta have higher ability to form carbides as compared with Cr and therefore prevent C, melted by welding heat, from forming Cr carbide, which precipitates at prior-austenite grain boundaries during cooling. That is, Ti, Nb, V, Zr, Hf, and Ta have ability to enhance the resistance to intergranular stress corrosion cracking of the HAZs. Carbide containing Ti, Nb, V, Zr, Hf, or Ta is hardly dissolved if the carbide is heated to a high temperature by welding heat; thereby decreasing dissolved carbon. This prevents the formation of Cr carbide to enhance the resistance to intergranular stress corrosion cracking of the HAZs. In order to achieve such advantages, it is preferable that the Ti content be 0.03% or more, the Nb content be 0.03% or more, the V content be 0.02% or more, the Zr content be 0.03% or more, the Hf content be 0.03% or more, or the Ta content be 0.03% or more. However, when the Ti content is more than 0.15%, the Nb content is more than 0.10%, the V content is more than 0.10%, the Zr content is more than 0.10%, the Hf content is more than 0.20%, or the Ta content is more than 0.20%, the steel pipe has low weld cracking resistance and toughness. Therefore, it is preferable that the Ti content be limited to 0.15% or less, the Nb content be limited to 0.10% or less, the V content be limited to 0.10% or less, the Zr content be limited to 0.10% or less, the Hf content be limited to 0.20% or less, or the Ta content be limited to 0.20% or less. It is more preferable that the Ti content be 0.03% to 0.12%, the Nb content be 0.03% to 0.08%, the V content be 0.02% to 0.08%, the Zr content be 0.03% to 0.08%, the Hf content be 0.10% to 0.18%, or the Ta content be 0.10% to 0.18%.

Ti is an element that has higher ability to reduce the effective content $C_{sol}$ of dissolved carbon as compared with other elements and is useful in enhancing the resistance to intergranular stress corrosion cracking. The Ti content is more preferably 0.06% to 0.10%.

V is an element useful in enhancing the high-temperature strength; hence, the steel pipe preferably contains V for a purpose of high temperature strength as well as that of an improved resistance to intergranular stress corrosion cracking. In order to such an advantage, the V content is preferably 0.02% or more. When the V content is less than 0.02%, the steel pipe has an insufficient strength at 80° C. to 150° C. In contrast, when the V content is more than 0.10%, the steel pipe has low toughness. The V content is more preferably 0.03% to 0.07%.

One or More Selected from the Group Consisting of 0.010% or Less Ca, 0.010% or Less Mg, 0.010% or Less REM, and 0.010% or Less B Ca, Mg, REM, and B are elements for enhancing the hot workability and the productivity of continuous casting processes. The steel pipe may contain at least one selected from those elements according to needs. In order to achieve such advantages, it is preferable that the Ca content be 0.0005% or more, the Mg content be 0.0010% or more, the REM content be 0.0010% or more, or the B content be 0.0005% or more. However, when the Ca content is more than 0.010%, the Mg content is more than 0.010%, the REM content is more than 0.010%, or the B content is more than 0.010%, those components are likely to form coarse inclusions to cause a serious deterioration in corrosion resistance and toughness. Therefore, it is preferable that the Ca content be limited to 0.010% or less, the Mg content be limited to 0.010% or less, the REM content be limited to 0.010% or less, or the B content be limited to 0.010% or less. Ca is useful in stabilizing the quality of the steel pipe and useful in reducing manufacturing cost. That is, Ca is preferable in quality stability and cost efficiency. The Ca content is more preferably within the range of 0.0005% to 0.0030%.

The remainder other than the above components are Fe and unavoidable impurities.

A preferable method for manufacturing steel pipes will now be described using a seamless steel pipe as an example.

Molten steel having the composition described above is preferably prepared with an ordinary furnace such as a converter, an electric furnace, or a vacuum melting furnace, and the other furnaces, and then processed into a steel pipe material such as a billet by a known such as a continuous casting machine or a slabbing mill for rolling an ingot. The steel pipe material is preferably heated, subjected to hot working with an ordinary manufacturing apparatus such as a Mannesmann-plug mill or a Mannesmann-mandrel mill, and then processed into a seamless steel pipe having a desired size. The obtained seamless steel pipe is preferably cooled to room temperature at a cooling rate greater than an air-cooling rate. No problem arises if the steel pipe material is processed into the seamless steel pipe with a press-type hot extrusion mill.

After being subjected to hot working and then cooling at a cooling rate greater than an air-cooling rate, the seamless steel pipe having the above composition has a martensitic microstructure. The seamless steel pipe subjected to hot working is preferably cooled to room temperature and then tempered. Alternatively, the seamless steel pipe subjected to hot working may be cooled to room temperature and then quenched in such a manner that the resulting pipe is reheated to a temperature higher than the $A_{c3}$ transformation temperature and then cooled at a cooling rate greater than an air-cooling rate. The quenched seamless steel pipe is preferably tempered at a temperature lower than the $A_{c1}$ transformation temperature.

The steel pipes are not limited to the type of seamless steel pipe described above. The steel pipe material with the above composition may be processed into a welded steel pipe such as an electric resistance welded pipe, a UOE steel pipe, or a spiral steel pipe by an ordinary procedure.

The martensitic stainless steel pipe is useful in manufacturing a welded structure by welding. Examples of the welded structure include oil or natural gas production facilities such as pipelines manufactured by girth-welding line pipes, chemical plant pipes such as risers and manifolds, and bridges. The welded structure specified herein may be manufactured by welding the martensitic stainless steel pipes, welding the martensitic stainless steel pipe of the present invention to another type of steel pipe, or welding the martensitic stainless steel pipe to a member made of another material.

EXAMPLES

Degassed molten steels having the compositions shown in Tables 1-1 and 1-2 were cast into 100 kg ingots, which were hot-forged and then subjected to hot working with a model seamless mill, whereby seamless steel pipes with an outer diameter of 65 mm and a thickness of 5.5 mm were prepared. After the tubulation, the seamless steel pipes were air-cooled.

The obtained seamless steel pipes were evaluated for hot workability as follows: they were kept cool after the tubulation and then visually inspected whether there were cracks in their outer and inner surfaces. Those having cracks in their outer and/or inner surfaces were evaluated to be inferior and those having no cracks were evaluated to be good.

Some of the obtained seamless steel pipes were quench-tempered, whereby X-80 grade steel pipes were prepared. Some of the seamless steel pipes were not quenched but tempered only.

The resulting steel pipes were subjected to a tensile test, a Charpy impact test, a carbon dioxide corrosion test, and a sulfide stress corrosion cracking test. Test procedures were as described below.

(1) Tensile Test

Specimens for a tensile test specified in the API standards were prepared from the obtained seamless steel pipes. The test pieces were subjected to the tensile test, whereby tensile properties (yield strength represented by YS and tensile strength represented by TS) thereof were determined, whereby the strength of the parent pipes was evaluated.

(2) Charpy Impact Test

V-notched test pieces (a thickness of 5.0 mm) were prepared from the obtained seamless steel pipes as specified in JIS Z 2202 and then subjected to a Charpy impact test as specified in JIS Z 2242, whereby the absorbed energy $vE_{-40}$ (J) at −40° C. was determined, whereby the toughness of the parent pipes was evaluated.

(3) Carbon Dioxide Corrosion Test

The obtained seamless steel pipes were machined into corrosion test pieces having a thickness of 3 mm, a width of 25 mm, and a length of 50 mm and then subjected to a corrosion test, whereby the $CO_2$ corrosion resistance and the pitting resistance were determined. The corrosion test was performed as follows: each test piece was immersed in a 20% NaCl aqueous solution placed in an autoclave for 30 days, the solution being saturated with $CO_2$ at 3.0 MPa and maintained at 150° C. The test piece subjected to the corrosion test was weighed and the corrosion rate was determined from a difference between the weight of the untreated test piece and that of the treated test piece. The treated test pieces were observed with a loupe with a magnification of 10× whether there were pits on surfaces of the test pieces. The test pieces having no pits were evaluated to be good and the test pieces having pits were evaluated to be inferior.

(4) Sulfide Stress Corrosion Cracking Test

Test pieces (a thickness of 4 mm, a width of 15 mm, and a length of 115 mm) for a four-point bending test were prepared from the obtained seamless steel pipes and then subjected to a four-point bending test specified in European Federation of Corrosion (EFC) No. 17, whereby the test pieces were evaluated for resistant to sulfide stress cracking. The test was performed as follows: a solution containing 5% NaCl and $NaHCO_3$ (a pH of 4.5) was used and a flowing gas mixture of 10% $H_2S$ and $CO_2$ was used. A stress equal to YS was applied to each test piece for 720 hours and the resulting test piece was observed whether it was broken. The unbroken test pieces were evaluated to be good and the broken test pieces were evaluated to be inferior. The symbol YS represents the yield strength of the parent pipes.

(5) U-Bend Test for Evaluating Resistance to Stress Corrosion Cracking

Test materials having a thickness of 4 mm, a width of 15 mm, and a length of 115 mm were prepared from the obtained seamless steel pipes. A simulated welding thermal cycle was applied to a center area of each test material, the cycle being simulated to a thermal cycle applied to a HAZ. As schematically shown in FIG. 1, the simulated welding thermal cycle includes a first step of maintaining the test material at 1300° C. for one second to cool the test material to 100° C. or less at such a cooling rate that the test material is cooled from 800° C. to 500° C. in nine seconds and a second step of maintaining the resulting test material at 450° C. for 180 seconds. A test piece having a thickness of 2 mm, a width of 15 mm, and a length of 75 mm was prepared from the center area of the test material suffering from the simulated welding thermal cycle and then subjected to a U-bend test for evaluating resistance to stress corrosion cracking.

Figure 2:
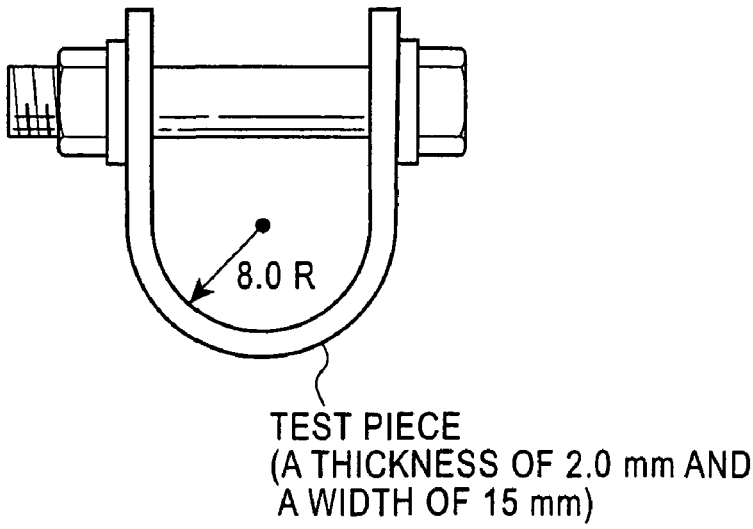
FIG. 2 is an illustration schematically showing a test piece bent in a U-bend test, performed in an example of our steel, for determining resistance to stress corrosion cracking.

In the U-bend test for evaluating resistance to stress corrosion cracking, the test piece was bent to form a U shape having an inner radius of 8 mm with a tool shown in FIG. 2 and then placed in a corrosive environment. The test period was 168 hours. Conditions of the corrosive environment were as follows: a solution temperature of 100° C., a $CO_2$ partial pressure of 0.1 MPa, and a 5% NaCl solution with a pH of 2.0. After the above test was performed, a cross section of the resulting test piece was observed with an optical microscope with a magnification of 100× whether there were any cracks, whereby the test piece was evaluated for resistance to intergranular stress corrosion cracking. The test pieces having cracks were evaluated to be inferior and the test pieces having no cracks were evaluated to be good. Obtained results are shown in Table 2-1 and 2-2.

All the test pieces of examples are superior in resistance to intergranular stress corrosion cracking that is likely to occur in HAZs because IGSCC is prevented from occurring in the HAZs without subjecting the test pieces to post-welding heat treatment. The steel pipes of the examples have high strength, toughness, $CO_2$ corrosion resistance, and resistant to sulfide stress cracking which are necessary for line pipes. The No. 20 steel pipe (an example) suffers from pitting in the carbon dioxide corrosion test and cracking in the sulfide stress corrosion cracking test because the steel pipe has a Mo content that is outside the more preferable range. However, this steel pipe does not suffer cracking in the U-bend test for evaluating resistance to stress corrosion cracking. Thus, no problem will arise if a steel pipe with a Mo content that is slightly outside the more preferable range is used as a line pipe as long as the line pipe need not have high $CO_2$ corrosion resistance, and resistant to sulfide stress cracking. In contrast, the steel pipes of comparative examples suffer from IGSCC which occurs in HAZs thereof, that is, the HAZs have an insufficient resistance to intergranular stress corrosion cracking.

INDUSTRIAL APPLICABILITY

We provide inexpensive martensitic stainless steel pipes having high strength, toughness, $CO_2$ corrosion resistance, resistance to stress corrosion cracking, and resistance to intergranular stress corrosion cracking. The martensitic stainless steel pipe is suitable for a base metal material for line pipes. In the martensitic stainless steel pipe, IGSCC can be prevented from occurring in a HAZ and needs not post-welding heat treatment. That is, the martensitic stainless steel pipe is industrially advantageous in particular. The martensitic stainless steel pipe of the present invention has high hot workability, hardly has surface defects, and is superior in productivity.

TABLE 1-1

| Steel No. | Chemical Components (% by mass) C | Si | Mn | P | S | Cr | Al | N | Ni | Cu, Mo, W, Co | Ti, Nb, V, Zr, Hf, Ta | Ca, Mg, REM, B | Cpre * | Csol ** | Remarks |
|---|---|---|---|---|---|---|---|---|---|---|---|---|---|---|---|
| A | 0.0045 | 0.15 | 0.85 | 0.019 | 0.001 | 12.1 | 0.020 | 0.0079 | 5.0 | 1.9% Mo | 0.057% V | 0.0012% Ca | 0 | 0.0045 | Example |
| B | 0.0035 | 0.22 | 0.52 | 0.018 | 0.001 | 11.1 | 0.018 | 0.0065 | 4.7 | 2.1% Mo | 0.051% V | 0.0016% Ca | 0 | 0.0035 | Example |
| C | 0.0011 | 0.25 | 0.45 | 0.018 | 0.001 | 12.2 | 0.022 | 0.0055 | 6.5 | 1.6% Mo | 0.038% V | 0.0008% Ca | 0 | 0.0011 | Example |

TABLE 1-1-continued

| Steel No. | Chemical Components (% by mass) C | Si | Mn | P | S | Cr | Al | N | Ni | Cu, Mo, W, Co | Ti, Nb, V, Zr, Hf, Ta | Ca, Mg, REM, B | Cpre * | Csol ** | Remarks |
|---|---|---|---|---|---|---|---|---|---|---|---|---|---|---|---|
| D | 0.0042 | 0.44 | 1.13 | 0.015 | 0.001 | 10.4 | 0.018 | 0.0078 | 4.2 | 2.1% Mo | 0.053% V | 0.0014% Ca | 0 | 0.0042 | Example |
| E | 0.0038 | 0.31 | 0.68 | 0.018 | 0.001 | 13.4 | 0.025 | 0.0059 | 7.3 | 2.6% Mo | 0.049% V | 0.0021% Ca | 0 | 0.0038 | Example |
| F | 0.0068 | 0.24 | 0.61 | 0.017 | 0.002 | 12.6 | 0.018 | 0.0078 | 6.1 | 2.3% Mo | 0.072% Ti and 0.051% V | 0.0022% Ca | 0.0154 | 0.0017 | Example |
| G | 0.0057 | 0.15 | 0.63 | 0.015 | 0.001 | 12.8 | 0.014 | 0.0070 | 6.2 | 2.7% Mo | 0.043% Ti and 0.063% V | 0.0023% Ca | 0.0097 | 0.0025 | Example |
| H | 0.0058 | 0.12 | 1.09 | 0.015 | 0.001 | 12.0 | 0.019 | 0.0046 | 5.9 | 2.5% Mo | 0.072% Nb and 0.044% V | 0.0023% Ca | 0.0042 | 0.0044 | Example |
| I | 0.0052 | 0.16 | 1.15 | 0.020 | 0.002 | 11.5 | 0.010 | 0.0073 | 6.5 | 2.1% Mo | 0.069% Nb and 0.039% V | 0.0009% Ca | 0.0013 | 0.0048 | Example |
| J | 0.0052 | 0.32 | 1.19 | 0.020 | 0.001 | 11.8 | 0.028 | 0.0063 | 4.8 | 1.6% Mo | 0.075% Zr and 0.030% V | 0.0021% Ca | 0.0019 | 0.0046 | Example |
| K | 0.0083 | 0.49 | 1.18 | 0.019 | 0.002 | 12.9 | 0.029 | 0.0082 | 6.5 | 2.1% Mo | 0.065% Ti, 0.031% Nb, and 0.051% V | 0.0010% Ca | 0.0153 | 0.0032 | Example |
| L | 0.0068 | 0.22 | 1.07 | 0.016 | 0.001 | 12.5 | 0.026 | 0.0064 | 4.8 | 2.2% Mo | 0.068% Nb, 0.059% Zr, and 0.063% V | 0.0021% Ca | 0.0077 | 0.0042 | Example |
| M | 0.0085 | 0.13 | 0.46 | 0.015 | 0.001 | 12.5 | 0.031 | 0.0062 | 5.6 | 2.6% Mo | 0.059% Ti, 0.021% Nb, 0.026% Zr, and 0.064% V | 0.0018% Ca | 0.0176 | 0.0026 | Example |
| N | 0.0135 | 0.13 | 0.05 | 0.020 | 0.001 | 12.5 | 0.018 | 0.0079 | 5.5 | 1.6% Mo | 0.061% Ti and 0.032% V | 0.0008% Ca | 0.0110 | 0.0098 | Comparative Example |
| O | 0.0075 | 0.25 | 0.55 | 0.017 | 0.002 | 12.3 | 0.023 | 0.0084 | 5.3 | 2.1% Mo | 0.035% V | 0.0015% Ca | 0 | 0.0075 | Comparative Example |
| P | 0.0088 | 0.22 | 0.03 | 0.018 | 0.002 | 12.9 | 0.022 | 0.0088 | 4.9 | 3.0% Mo | 0.031% Ti and 0.042% V | 0.0010% Ca | 0.0035 | 0.0076 | Comparative Example |
| Q | 0.0078 | 0.46 | 0.34 | 0.019 | 0.001 | 12.0 | 0.030 | 0.0058 | 4.5 | 1.9% Mo | 0.186% Ti and 0.039% V | 0.0011% Ca | 0.0447 | −0.0071 | Comparative Example |
| R | 0.0051 | 0.18 | 0.82 | 0.017 | 0.001 | 12.6 | 0.030 | 0.0053 | 4.1 | 0.4% Mo | 0.035% Ti and 0.058% V | 0.0019% Ca | 0.0088 | 0.0022 | Example |
| S | 0.0084 | 0.41 | 0.34 | 0.020 | 0.002 | 12.8 | 0.024 | 0.0081 | 5.2 | 2.4% Mo | 0.035% Ti, 0.033% Nb, 0.036% Zr, and 0.061% V | — | 0.0128 | 0.0041 | Example |

* Cpre = 12.0 {Ti/47.9 + 1/2 (Nb/92.9 + Zr/91.2) + 1/3 (V/50.9 + Hf/178.5 + Ta/180.9) − N/14.0} or Cpre = 0 when Cpre < 0
** Csol = C − 1/3 × Cpre

TABLE 1-2

| Steel No. | Chemical Components (% by mass) C | Si | Mn | P | S | Cr | Al | N | Ni | Cu, Mo, W, Co | Ti, Nb, V, Zr, Hf, Ta | Ca, Mg, REM, B | Cpre * | Csol ** | Remarks |
|---|---|---|---|---|---|---|---|---|---|---|---|---|---|---|---|
| 1A | 0.0062 | 0.25 | 0.44 | 0.015 | 0.001 | 12.0 | 0.020 | 0.0061 | 5.1 | 3.2% Cu | 0.035% Ti and 0.072% V | 0.0021% Ca | 0.0092 | 0.0031 | Example |
| 1B | 0.0076 | 0.30 | 0.51 | 0.016 | 0.001 | 11.9 | 0.030 | 0.0079 | 4.9 | 1.2% Mo | 0.068% Ti and 0.048% V | 0.0017% Ca | 0.0140 | 0.0029 | Example |
| 1C | 0.0069 | 0.19 | 0.35 | 0.018 | 0.001 | 11.3 | 0.019 | 0.0082 | 5.3 | 1.3% W | 0.050% Ti and 0.041% V | 0.0020% Ca | 0.0087 | 0.0040 | Example |
| 1D | 0.0045 | 0.41 | 0.87 | 0.012 | 0.001 | 11.8 | 0.025 | 0.0025 | 5.4 | 1.6% Mo | 0.143% Hf | — | 0.0011 | 0.0041 | Example |
| 1E | 0.0043 | 0.35 | 1.36 | 0.014 | 0.001 | 12.3 | 0.024 | 0.0025 | 4.5 | 1.8% W | 0.157% Ta | — | 0.0013 | 0.0039 | Example |
| 1F | 0.0068 | 0.24 | 1.02 | 0.009 | 0.001 | 12.5 | 0.030 | 0.0068 | 5.1 | 2.0% Mo | 0.065% Ti and 0.035% V | 0.0025% Mg | 0.0132 | 0.0024 | Example |
| 1G | 0.0081 | 0.26 | 0.62 | 0.012 | 0.001 | 12.1 | 0.024 | 0.0063 | 5.2 | 2.1% Mo | 0.073% Ti, 0.012% Nb, and 0.041% V | 0.0054% REM | 0.0169 | 0.0025 | Example |
| 1H | 0.0075 | 0.25 | 0.45 | 0.013 | 0.001 | 12.0 | 0.023 | 0.0072 | 4.8 | 1.9% Mo | 0.079% Ti and 0.026% V | 0.0015% B | 0.0157 | 0.0023 | Example |
| 1I | 0.0068 | 0.24 | 0.55 | 0.012 | 0.001 | 12.2 | 0.031 | 0.0075 | 5.1 | 2.9% Co | 0.069% Ti and 0.036% V | 0.0015% Ca | 0.0137 | 0.0022 | Example |

* Cpre = 12.0 {Ti/47.9 + 1/2 (Nb/92.9 + Zr/91.2) + 1/3 (V/50.9 + Hf/178.5 + Ta/180.9) − N/14.0} or Cpre = 0 when Cpre < 0
** Csol = C − 1/3 × Cpre

TABLE 2-1

| Steel Pipe No | Steel No. | Hot Workability | Heat Treatment | Tensile Properties YS MPa | Tensile Properties TS MPa | Toughness $VE_{-40}$ J | $CO_2$ Corrosion Resistance Corrosion Rate (mm/yr) | $CO_2$ Corrosion Resistance Pits | Resistant to Sulfide Stress Cracking | Resistance to Intergranular Stress Corrosion of HAZ Cracks | Remarks |
|---|---|---|---|---|---|---|---|---|---|---|---|
| 1 | A | Good | QT | 623 | 853 | 227 | 0.033 | Not Observed | Good | Not Observed | Example |
| 2 | A | Good | T | 611 | 849 | 236 | 0.034 | Not Observed | Good | Not Observed | Example |
| 3 | B | Good | QT | 592 | 779 | 233 | 0.055 | Not Observed | Good | Not Observed | Example |
| 4 | C | Good | QT | 621 | 875 | 238 | 0.087 | Not Observed | Good | Not Observed | Example |
| 5 | D | Good | QT | 626 | 882 | 231 | 0.103 | Not Observed | Good | Not Observed | Example |
| 6 | E | Good | QT | 579 | 702 | 238 | 0.021 | Not Observed | Good | Not Observed | Example |
| 7 | F | Good | QT | 608 | 770 | 204 | 0.048 | Not Observed | Good | Not Observed | Example |
| 8 | F | Good | T | 639 | 900 | 243 | 0.046 | Not Observed | Good | Not Observed | Example |
| 9 | G | Good | QT | 626 | 773 | 228 | 0.043 | Not Observed | Good | Not Observed | Example |
| 10 | H | Good | QT | 599 | 732 | 219 | 0.069 | Not Observed | Good | Not Observed | Example |
| 11 | I | Good | QT | 634 | 768 | 202 | 0.055 | Not Observed | Good | Not Observed | Example |
| 12 | J | Good | QT | 575 | 701 | 234 | 0.033 | Not Observed | Good | Not Observed | Example |
| 13 | K | Good | QT | 619 | 814 | 219 | 0.060 | Not Observed | Good | Not Observed | Example |
| 14 | L | Good | QT | 614 | 797 | 238 | 0.088 | Not Observed | Good | Not Observed | Example |
| 15 | M | Good | QT | 639 | 864 | 250 | 0.092 | Not Observed | Good | Not Observed | Example |
| 16 | N | Good | QT | 607 | 749 | 227 | 0.105 | Not Observed | Good | Observed | Comparative Example |
| 17 | 0 | Good | QT | 615 | 842 | 202 | 0.084 | Not Observed | Good | Observed | Comparative Example |
| 18 | P | Good | QT | 585 | 750 | 222 | 0.077 | Not Observed | Good | Observed | Comparative Example |
| 19 | Q | Good | QT | 636 | 896 | 62 | 0.092 | Not Observed | Good | Not Observed | Comparative Example |
| 20 | R | Good | QT | 612 | 746 | 247 | 0.098 | Observed | Inferior | Not Observed | Example |
| 21 | S | Inferior | QT | 605 | 742 | 211 | 0.086 | Not Observed | Good | Not Observed | Example |

TABLE 2-2

| Steel Pipe No. | Steel No. | Hot Workability | Heat Treatment | Tensile Properties YS MPa | Tensile Properties TS MPa | Toughness $VE_{-40}$ J | $CO_2$ Corrosion Resistance Corrosion Rate (mm/yr) | $CO_2$ Corrosion Resistance Pitting | Resistant to Sulfide Stress Cracking | Resistance to Intergranular Stress Corrosion of HAZ Cracks | Remarks |
|---|---|---|---|---|---|---|---|---|---|---|---|
| 22 | 1A | Good | QT | 610 | 735 | 203 | 0.054 | Not Observed | Good | Not Observed | Example |
| 24 | 1B | Good | QT | 620 | 765 | 211 | 0.054 | Not Observed | Good | Not Observed | Example |
| 25 | 1C | Good | QT | 601 | 752 | 209 | 0.045 | Not Observed | Good | Not Observed | Example |
| 26 | 1D | Good | QT | 612 | 768 | 211 | 0.053 | Not Observed | Good | Not Observed | Example |
| 27 | 1E | Good | QT | 598 | 784 | 206 | 0.045 | Not Observed | Good | Not Observed | Example |
| 28 | 1F | Good | QT | 589 | 769 | 213 | 0.042 | Not Observed | Good | Not Observed | Example |
| 29 | 1G | Good | QT | 579 | 751 | 203 | 0.043 | Not Observed | Good | Not Observed | Example |
| 30 | 1H | Good | QT | 621 | 743 | 211 | 0.047 | Not Observed | Good | Not Observed | Example |
| 31 | 1I | Good | QT | 631 | 752 | 209 | 0.051 | Not Observed | Good | Not Observed | Example |

The invention claimed is:

1. A martensitic stainless steel seamless pipe containing:

less than 0.0100% of C and less than or equal to 0.0050% of $C_{sol}$;

less than 0.0100% of N;

about 10% to about 14% of Cr;

about 4% to about 7% of Ni;

about 0.05% to about 1.0% of Si;

about 0.1% to about 2.0% of Mn;

about 0.3% or less of P;

about 0.010% or less of S;

about 0.001% to about 0.10% of Al;

0.02% to 0.1% of V;

one or more selected from the group consisting of about 4% or less of Cu, about 4% or less of Co, about 4% or less of Mo, and about 4% or less of W; and one or more selected from the group consisting of about 0.15% or less of Ti, about 0.10% or less of Nb, about 0.10% or less of Zr, about 0.20% or less of Hf, and about 0.20% or less of Ta on a mass basis, the remainder being Fe and unavoidable impurities, wherein $C_{sol}$ is determined by equation (1):

$$C_{sol}=C-\tfrac{1}{3}\times C_{pre} \quad (1)$$

where $C_{pre}=12.0\ \{Ti/47.9+\tfrac{1}{2}(Nb/92.9+Zr/91.2)+\tfrac{1}{3}(V/50.9+Hf/178.5+Ta/180.9)-N/14.0\}$ or $C_{pre}=0$ when $C_{pre}<0$, where C represents the carbon content, Ti represents the titanium content, Nb represents the niobium content, Zr represents the zirconium content, V represents the vanadium content, Hf represents the hafnium content, Ta represents the tantalum content, and N represents the nitrogen content on a mass basis, and martensite in a weld heat affected zone of the steel pipe is substantially free of Cr depleted zones.

2. The martensitic stainless steel seamless pipe according to claim 1 further containing one or more selected from the group consisting of about 0.010% or less of Ca, about 0.010% or less of Mg, about 0:010% or less of REM, and about 0.010% or less of B on a mass basis.

3. A line pipe comprising the martensitic stainless steel seamless pipe according to claim 2.

4. A welded structure comprising the martensitic stainless steel seamless pipe according to claim 2, welded to a member.

5. A welded structure comprising the seamless line pipe according to claim 3.

6. A seamless line pipe comprising the martensitic stainless steel pipe according claim 1.

7. A welded structure comprising the seamless line pipe according to claim 6.

8. A welded structure comprising the martensitic stainless steel seamless pipe according to claim 1, welded to a member.

9. A martensitic stainless steel seamless pipe containing:

less than 0.0100% of C and less than or equal to 0.0050% of $C_{sol}$;

less than 0.0100% of N;

about 10% to about 14% of Cr;

about 4% to about 7% of Ni;

about 0.05% to about 1.0% of Si;

about 0.1% to about 2.0% of Mn;

about 0.03% Or less of P;

about 0.010% or less of S;

about 0.001% to about 0.10% of Al;

about 0.02% to about 0.10% of V;

about 0.0005% to about 0.010% of Ca; and one or more selected from the group consisting of about 4% or less of Cu, about 4% or less of Co, about 4% or less of Mo, and about 4% or less of W on a mass basis, the remainder being Fe and unavoidable impurities, wherein $C_{sol}$ is determined by equation (1):

$$C_{sol}=C-\tfrac{1}{3}\times C_{pre} \quad (1)$$

where $C_{pre}=12.0\ \{Ti/47.9+\tfrac{1}{2}(Nb/92.9+Zr/91.2)+\tfrac{1}{3}(V/50.9+Hf/178.5+Ta/180.9)-N/14.0\}$ or $C_{pre}=0$ when $C_{pre}<0$, where C represents the carbon content, Ti represents the titanium content, Nb represents the niobium content, Zr represents the zirconium content, V represents the vanadium content, Hf represents the hafnium content, Ta represents the tantalum content, and N represents the nitrogen content on a mass basis, and martensite in a weld heat affected zone of the steel pipe is substantially free of Cr depleted zones.

10. The martensitic stainless steel seamless pipe according to claim 9 further containing one or more selected from the group consisting of about 0.15% or less of Ti, about 0.10% or less of Nb, about 0.10% or less of Zr, about 0.20% or less of Hf, and about 0.20% or less of Ta on a mass basis.

11. A line pipe comprising the martensitic stainless steel seamless pipe according to claim 10.

12. A welded structure comprising the martensitic stainless steel seamless pipe according to claim 10, welded to a member.

13. A welded structure comprising the seamless line pipe according to claim 11.

14. A line pipe comprising the martensitic stainless steel seamless pipe according to claim 9.

15. A welded structure comprising the seamless line pipe according to claim 14.

16. A welded structure comprising the martensitic stainless steel seamless pipe according to claim 9, welded to a member.

* * * * *